US010065771B2

(12) United States Patent
Kissner et al.

(10) Patent No.: US 10,065,771 B2
(45) Date of Patent: Sep. 4, 2018

(54) CONTAINER LID HAVING SELECTIVELY COVERABLE ACCESS OPENING

(71) Applicant: Kraft Foods Group Brands LLC, Chicago, IL (US)

(72) Inventors: Douglas Robert Kissner, Glenview, IL (US); Abby Rose Herstich, Chicago, IL (US); Michele Marie Dziaba, Mundelein, IL (US); Takeisa R. Sledge, Chicago, IL (US)

(73) Assignee: Kraft Foods Group Brands LLC, Chicago, IL (US)

( * ) Notice: Subject to any disclaimer, the term of this patent is extended or adjusted under 35 U.S.C. 154(b) by 0 days.

(21) Appl. No.: 15/730,624

(22) Filed: Oct. 11, 2017

(65) Prior Publication Data

US 2018/0029756 A1 Feb. 1, 2018

Related U.S. Application Data

(62) Division of application No. 13/333,662, filed on Dec. 21, 2011, now Pat. No. 9,809,356.
(Continued)

(51) Int. Cl.
*B65D 43/16* (2006.01)
*B65D 43/02* (2006.01)

(52) U.S. Cl.
CPC ..... *B65D 43/0212* (2013.01); *B65D 43/169* (2013.01); *B65D 2251/0021* (2013.01);
(Continued)

(58) Field of Classification Search
CPC ..... B65D 43/0212; B65D 43/169; B65D 2251/1008; B65D 2543/00796;
(Continued)

(56) References Cited

U.S. PATENT DOCUMENTS 3,255,928 A 6/1966 Foster
3,392,870 A 7/1968 Schulz
(Continued)

FOREIGN PATENT DOCUMENTS

EP 0579225 1/1994
GB 2162821 2/1986
(Continued)

*Primary Examiner* — James N Smalley
(74) *Attorney, Agent, or Firm* — Fitch, Even, Tabin & Flannery LLP

(57) ABSTRACT

A lid is provided that includes an access opening in a top wall thereof selectively coverable by a pivotable cover. The lid attaches to a foodstuff container and provides access to an interior of the container. The lid achieves this without requiring removal of the lid while also providing an impeded foodstuff dispense path having greater control. The cover pivots between open and closed positions, and in one form, can be secured in one or both positions. This can be achieved by releasably securing the cover to the top wall to hold the cover in the closed position and/or capturing a tab of the cover within a depression in an edge portion of the lid to hold the cover in the open position. The cover can further be integrally attached to the lid so that the cover is generally coplanar with the top wall when in the closed position.

9 Claims, 3 Drawing Sheets

Related U.S. Application Data

(60) Provisional application No. 61/426,358, filed on Dec. 22, 2010.

(52) U.S. Cl.
CPC ..... *B65D 2251/1008* (2013.01); *B65D 2251/1041* (2013.01); *B65D 2543/0074* (2013.01); *B65D 2543/00148* (2013.01); *B65D 2543/00296* (2013.01); *B65D 2543/00379* (2013.01); *B65D 2543/00537* (2013.01); *B65D 2543/00796* (2013.01)

(58) Field of Classification Search
CPC .. B65D 2543/0074; B65D 2543/00537; B65D 2543/00296; B65D 2543/00148; B65D 2251/1041; B65D 2543/00379; B65D 2251/0021
USPC ..... 220/831, 832, 254.3, 712
See application file for complete search history.

(56) References Cited

U.S. PATENT DOCUMENTS

| | | | | |
|---|---|---|---|---|
| 3,417,897 | A | 12/1968 | Johnson | |
| 3,469,732 | A | 9/1969 | Foster | |
| 3,872,996 | A | 3/1975 | Dogliotti | |
| 3,904,074 | A | 9/1975 | Hoffman | |
| 4,202,459 | A * | 5/1980 | DeParales | B65D 43/0218 220/254.3 |
| 4,361,250 | A | 11/1982 | Foster | |
| 4,362,254 | A | 12/1982 | Roth | |
| 4,487,328 | A | 12/1984 | Wilcox | |
| 4,538,731 | A | 9/1985 | Cillario | |
| 4,724,978 | A | 2/1988 | Cleevely | |
| 4,739,900 | A | 4/1988 | Borst | |
| 4,858,793 | A | 8/1989 | Stone | |
| 4,874,103 | A | 10/1989 | Quisenberry | |
| 4,949,865 | A * | 8/1990 | Turner | B65D 47/0847 220/254.3 |
| 4,955,513 | A | 9/1990 | Bennett | |
| 5,085,331 | A | 2/1992 | Groya | |
| 5,111,956 | A | 5/1992 | Jow | |
| 5,190,152 | A | 3/1993 | Smith | |
| 5,337,911 | A | 8/1994 | Holub | |
| 5,402,904 | A | 4/1995 | Close | |
| 5,494,186 | A | 2/1996 | Marsh | |
| 5,657,894 | A | 8/1997 | Bowen | |
| 5,927,535 | A | 7/1999 | Goth | |
| 5,988,424 | A | 11/1999 | Kovens | |
| D431,458 | S | 10/2000 | Bried | |
| 6,237,765 | B1 | 5/2001 | Hagen | |
| 6,352,170 | B1 | 3/2002 | Brown | |
| 6,360,909 | B1 | 3/2002 | Bridge | |
| D456,713 | S | 5/2002 | Bried | |
| D462,613 | S | 9/2002 | Bried | |
| D474,402 | S | 5/2003 | Baerenwald | |
| 6,575,323 | B1 | 6/2003 | Martin | |
| 6,783,019 | B2 * | 8/2004 | Zettle | B65D 43/0212 220/254.3 |
| D522,362 | S | 6/2006 | Liebe | |
| D537,717 | S | 3/2007 | Notarianni | |
| 7,258,255 | B2 | 8/2007 | Vogel | |
| D607,315 | S | 1/2010 | George | |
| D631,338 | S | 1/2011 | Prevost | |
| D639,658 | S | 6/2011 | Yacht | |
| D654,787 | S | 2/2012 | Kissner | |
| 8,132,690 | B2 | 3/2012 | Hall | |
| 2004/0195238 | A1 | 10/2004 | Brija | |
| 2006/0124643 | A1 | 6/2006 | Markert | |
| 2006/0138136 | A1 | 6/2006 | Frey | |
| 2006/0151512 | A1 | 7/2006 | Van Heugten | |
| 2007/0095845 | A1 | 5/2007 | Auer | |
| 2007/0164027 | A1 | 7/2007 | Auer | |
| 2008/0083768 | A1 | 4/2008 | Luburic | |
| 2008/0190951 | A1 | 8/2008 | Gallagher | |
| 2008/0230543 | A1 | 9/2008 | Kick | |
| 2009/0266828 | A1 * | 10/2009 | Cai | B65D 43/0212 220/712 |
| 2010/0108675 | A1 | 5/2010 | Meissen | |
| 2010/0140266 | A1 | 6/2010 | Lohrman | |
| 2011/0170807 | A1 | 7/2011 | Khubani | |
| 2011/0248033 | A1 | 10/2011 | Mehrvijeh | |
| 2012/0031903 | A1 | 2/2012 | Antal | |
| 2012/0164283 | A1 | 6/2012 | Kissner | |
| 2012/0223074 | A1 | 9/2012 | Porter | |
| 2013/0068765 | A1 * | 3/2013 | Procter | B65D 43/0212 220/254.3 |

FOREIGN PATENT DOCUMENTS

| | | |
|---|---|---|
| JP | 2008265790 | 11/2008 |
| WO | 2008103343 | 8/2008 |

* cited by examiner

CONTAINER LID HAVING SELECTIVELY COVERABLE ACCESS OPENING

CROSS-REFERENCE TO RELATED APPLICATION

This application is a divisional of U.S. application Ser. No. 13/333,662, filed Dec. 21, 2011, which claims the benefit of U.S. Application No. 61/426,358, filed Dec. 22, 2010, each of which is hereby incorporated by reference in its entirety.

FIELD

Lids for containers, and in particular lids having selectively coverable access openings.

BACKGROUND

Lidded containers for food products such as cheese crumbles are known. One such type of container can include a recloseable snap-fit lid. While this type of container can provide secure reclosing, it can also have disadvantageous attributes. For example, cheese crumbles are typically sequentially consumed over a period of time, which requires repeated dispensing. A container having a recloseable snap-fit lid therefore can require repeated removal and attachment of the lid every time additional product is desired. This can be inconvenient and can decrease the utility of the container.

Another type of container includes a form, fill, and seal package with a thin flexible wall attached to an upper peripheral flange thereof. This type of container can be opened by peeling a portion of the film off of the base flange and reclosed by reapplying the film to the earlier exposed adhesive after some of the food product is dispensed. One problem that can occur from this configuration, however, is that the food product is able to adhere to the exposed adhesive, which can hinder reclosure. Additionally, such a container can utilize relatively flexible sidewalls along with the peelable film covering. A food product contained in such a container can be damaged as a result of objects crushing the container or otherwise impacting the food product through the flexible container walls.

One dispensing method for a food product like cheese crumbles includes shaking the product out of the container. Containers such as those described above, when utilized in this way, can provide a large, unimpeded opening consisting in a lower part of a container sidewall. Such a large opening can result in over dispensing or dispensing that occurs faster than is expected.

SUMMARY

A lid is provided that includes an access opening. A hinged cover of the lid provides selective access to the opening. The lid is configured to attach to a container, such as a container utilized to store a food product, so that the selectively coverable access opening is positioned to provide access to an interior of the container for removal or dispensing of the food product. This advantageously allows a consumer to access the food product without removing the lid and also provides a smaller dispense opening. The cover is pivotable about a hinge between a closed configuration covering the opening and an open configuration exposing the opening. By one approach, the cover secures in the closed and/or open configurations. More particularly, the lid includes a top wall that defines the opening therein. The top wall can extend inward from a sidewall of the container and this advantageously provides an impediment against free flow of the food product through the opening. The cover and the top wall snap fit together to hold the cover in the closed configuration. This advantageously secures the cover in the closed configuration without the use of adhesives. In another form, the lid further includes an upstanding wall extending at least partially around a periphery of the top wall. In this form, the cover and the upstanding wall cooperate to hold the cover in the open position.

In one form, a unitary lid is provided with a generally planar top wall having an opening therein. The lid includes a peripheral rim that extends at least partially about the top wall to attach the lid to a container. A cover integrally attaches to the top wall via a hinge and is movable between a closed position that covers the opening and an open position that exposes the opening. When in the closed position, the cover is substantially coplanar with the top wall. This advantageously provides an even upper surface for the lid and container for stacking purposes both commercially and for private use.

In another form, a lid includes a top wall with outer edge portion and an opening spaced inwardly from the outer edge portion. The lid further includes an upstanding wall that extends around portions of a periphery of the top wall. A cover is positioned inwardly of the upstanding wall and attaches to the top wall via a hinge. The hinge is disposed adjacent the opening so that the cover can be moved between a closed position where it covers the opening and an open position where it exposes the opening. In this form, the lid advantageously includes structure configured to secure the lid in the open and closed positions respectively. A protuberance extends downwardly and outwardly from an edge portion of the cover, so that when the cover is in the closed position, the protuberance projects under the top wall of the lid to releasably hold the cover in the closed position. The cover further includes a tab that projects outwardly from an edge portion of the cover and the upstanding wall includes a gap therein positioned to receive and capture the tab when the cover is in the open position.

A method is also provided for opening a foodstuff package. The package includes a lid secured to a container. The lid includes a top wall with an opening and a cover pivotably attached to the top wall via a hinge. A user grips a tab of the cover and disengages a portion of the cover from the top wall. The user than pivots the cover about the hinge to expose the opening in the top wall. This provides access to an interior of the container through the opening. The user secures the cover in an open position by capturing the tab within a depression in a periphery of the lid.

DETAILED DESCRIPTION

Figure 1:
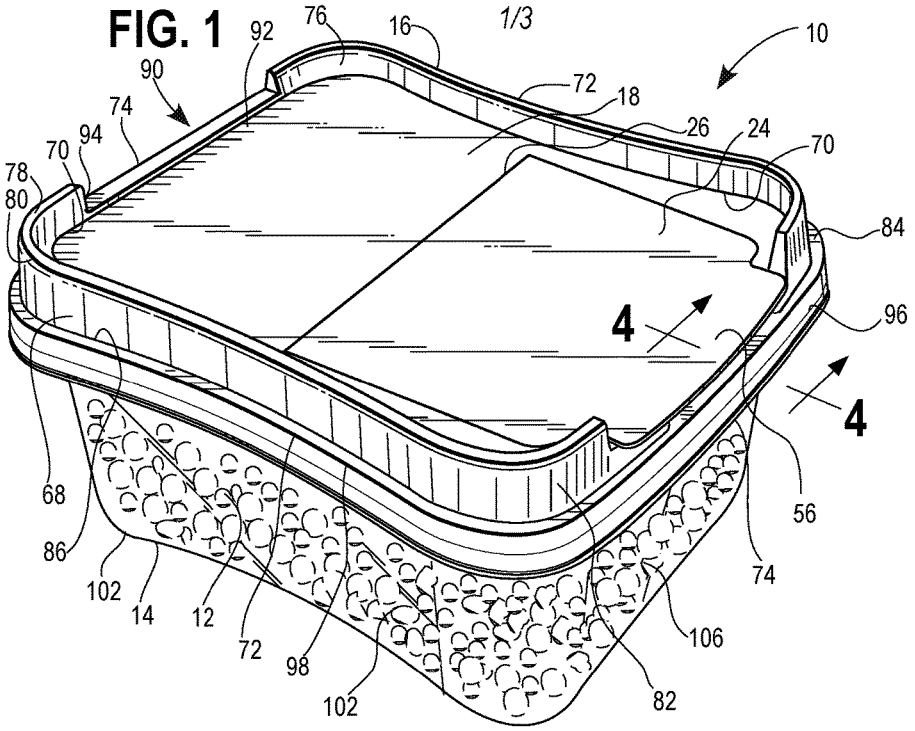
FIG. 1 is a perspective view of a package for a foodstuff including a container and a lid showing a pivotable cover of the lid in a closed position.

A lid is provided that includes an access opening in a top wall thereof selectively coverable by a pivotable cover. The lid attaches to a foodstuff container and provides access to an interior of the container. The lid achieves this without requiring removal of the lid while also providing an impeded foodstuff dispense path having greater control. The cover pivots between open and closed positions, and in one form, can be secured in one or both positions. This can be achieved by releasably securing the cover to the top wall to hold the cover in the closed position and/or capturing a tab of the cover within a depression in an edge portion of the lid to hold the cover in the open position. The cover can further be integrally attached to the lid so that the cover is generally coplanar with the top wall when in the closed position.

Turning now to the exemplary embodiment of FIGS. 1-5, a package 10 for a food product 12 is shown having a container 14 and a lid 16. The lid 16 removably attaches to the container 14, such as by snap-fit or the like. The lid 16 includes an upwardly facing top wall 18 that defines an opening 20 therein. With the lid 16 attached to the container 14, the opening 20 provides access to an interior 22 of the container 14 through the lid 16, which advantageously avoids having to repeatedly remove the lid 16 to sequentially remove the food product 12 from the container 14. A cover 24 pivotably attaches to the lid 16 and is movable between a closed positioned covering the opening 20 and an open position exposing the opening 20.

By one approach, the cover 24 attaches to the top wall 18 via a hinge 26, such as a living hinge, a fold, an area of weakness, separate hardware, or the like. In order to reduce or remove memory from the hinge 26, which refers to a tendency of the hinge 26 to leave the cover 24 in a pivoted condition after pivoting thereof, by adding further areas of weakness, such as areas of the hinge 26 with a reduced cross-sectional depth with respect to adjacent areas of the hinge 26. So configured, the cover 24 can be manipulated or otherwise pivoted about the hinge 26 between the open and closed configurations. In the illustrated form, the top wall 18 and the cover 24 are substantially planar. The hinge 26 can be a living hinge or otherwise positioned so that the top wall 18 and the cover 24 are substantially co-planar in the closed position, as illustrated in FIG. 1. This advantageously provides a smooth and even upper surface of the container for a label or other graphic, secure stacking, or the like.

As discussed above, the cover 24 can secure in the closed configuration to prevent spillage of the food product and/or to generally close off the interior 22 of the container 14. By one approach, a protuberance 28 or the like projects downwardly from a bottom surface 30 of the cover 24. An outwardly projecting portion 32 projects away from the protuberance 28 and is configured to extend to a position under the top wall 18 when the cover 24 is in the closed condition to provide resistance against opening the cover 24. In the illustrated form, the outwardly projecting portion 32 is spaced from the cover bottom surface 30 between about 1/32 inch to about 1/16 inch and projects outwardly between about 1/64 inch to about 1/32 inch. The outwardly projecting portion 32 tapers downwardly to a point or thin section 34 so that the outwardly projecting portion 32 does not abut the top wall 18 when the cover 24 is pressed into the closed configuration. The outward taper of the outwardly projecting portion 32 then slightly distorts or bends the top wall 18 adjacent to the opening until the outwardly projecting portion 32 is forced below the top wall 18 and the resilient top wall 18 at least partially returns to its original position so as to be at least partially positioned above the outwardly projecting portion 32. In another form, the top wall 18 can further include an inclined or rounded surface or ramp 35 positioned within the pivoting path of the protuberance 28. The ramp 35 and the taper of the protuberance 28 cooperate to provide greater ease of closure for the cover 24. So configured, the protuberance 28 can hold the cover 24 in the closed configuration and resist opening of the cover 24, such as when the package 10 is turned over to prevent spillage of the food product 12, but can still be relatively easily overcome by manipulation to expose the opening 20.

Figure 2:
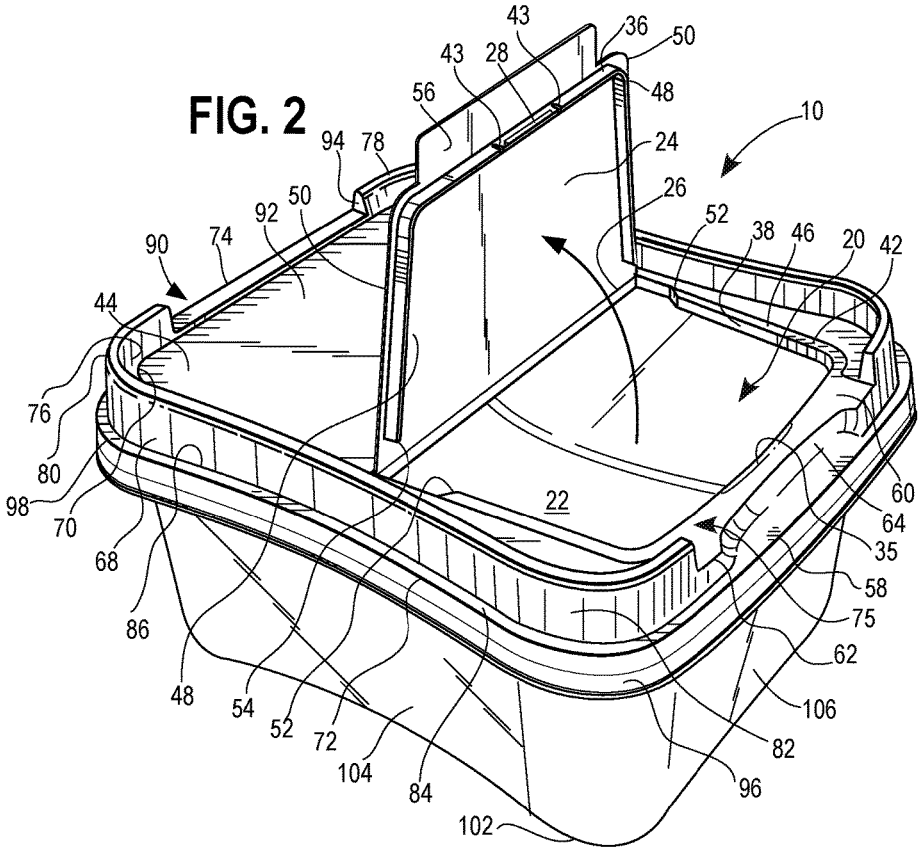
FIG. 2 is a perspective view of the package of FIG. 1 showing the cover pivoted to a generally perpendicular open position.
Figure 5:
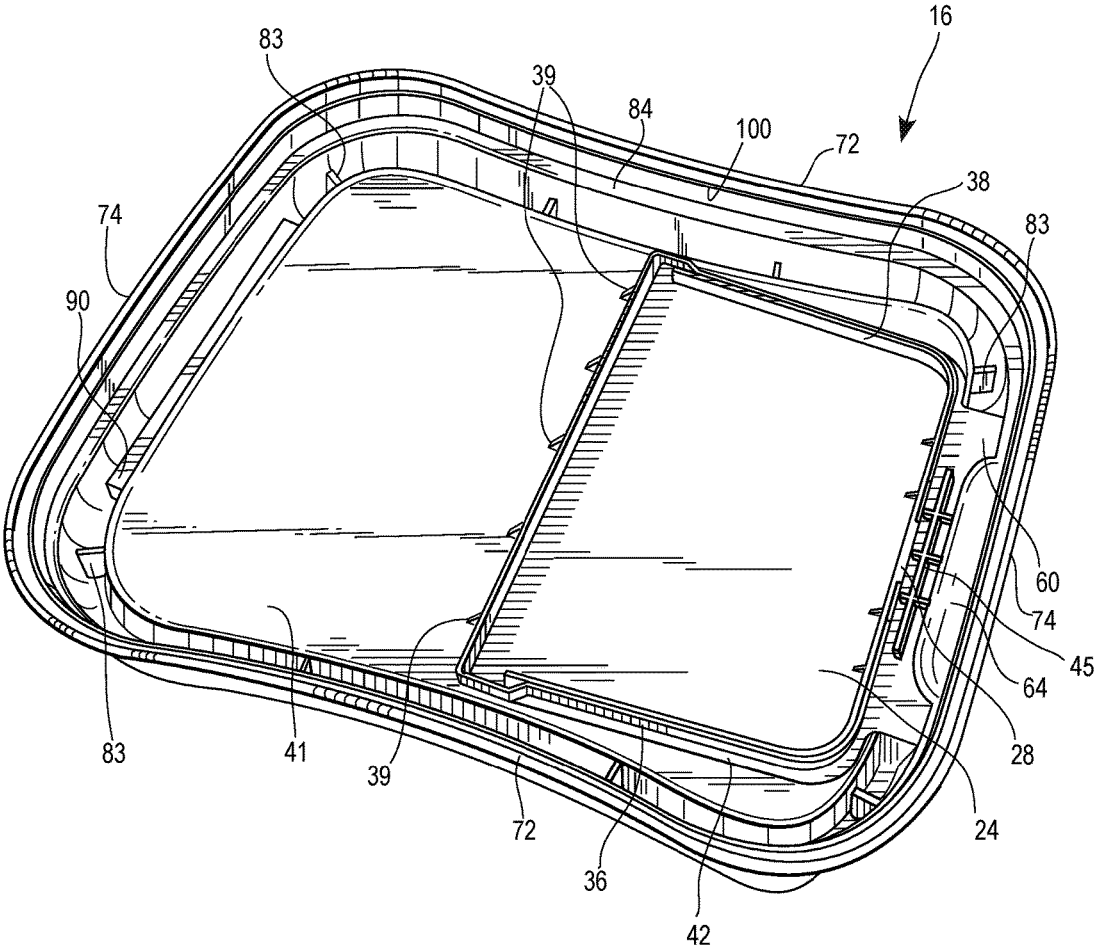
FIG. 5 is a bottom perspective view of the lid of FIG. 1 showing the cover in the closed position.

The cover 24 and/or the opening 20 can be strengthened to provide greater structure to the cover 24 and/or top wall 18. The exemplary strengthening structure includes an inner depending wall or rib 36 that projects from the bottom surface 30 of the cover 24. The inner depending wall 36 allows the cover to keep a substantially planar profile while being manipulated and stored, where a flexible or thin plastic would have a tendency to bend or twist under force. In another form, the top wall 18 can include an outer depending wall or rib 38 that projects from a bottom surface 41 of the top wall 18 adjacent the opening 20. The inner and outer depending walls 36, 38 are best shown in FIGS. 2 and 5. As illustrated, the inner and outer depending walls 36, 38 are positioned adjacent to one another when the cover 24 is in the closed configuration. Depending upon the proximity of the walls to each other, this can advantageously increase moisture retention in high moisture food products, such as cheese, and can restrict air flow through the container interior 22 when the cover 24 is in the closed configuration. The outer depending wall 38 can further include one or more lid braces 39 to support the wall and strengthen the top wall 18. As shown in FIG. 5, the braces 39 are positioned along the depending wall 38 adjacent to the hinge 26, but can also be provided on the other sides of the depending wall 38. Additionally, the braces 39 can be used to strengthen the inner depending wall 36 along one or more sides thereof. The braces 39 can take any suitable shape, such as generally triangular as shown, or rounded or rectangular, or the like. By another approach, strengthening ribs 45 can be provided on the bottom surface 41 of the top wall 18 to strengthen the top wall 18. Specifically, the ribs 45 can be a cross-hatch pattern and positioned on the bottom surface 41 of the top wall 18 adjacent to the protuberance 28 and the inner depending wall 36. The cross-hatch can strengthen the top wall 18 against flexure and therefore cause the protuberance 28 to flex a relatively greater distance and provide a relatively securer engagement of the cover 24 to the top wall 18.

In the form as discussed above with the protuberance 28, the inner and outer depending walls 36, 38 can be configured to accommodate this securing structure. In one form, the downward length of the protuberance 28 is a portion of the inner depending wall 36 and the outwardly projecting portion 32 extends outwardly from the inner depending wall 36. As shown in FIG. 2, the protuberance 28 can be at least partially separated from the adjacent portions of the inner depending wall 36 by notches 43. The notches 43 can allow the protuberance 28 to easily flex when the cover 24 is pivoted between open and closed positions. Additionally, the outer depending wall 38 includes a gap or recess 40 therein through which the outwardly projecting portion 32 extends when the cover 24 is in the closed configuration. The depth of the gap 40 can be sized so that the outwardly projecting portion 32 is continually abutted or can alternatively be sized to provide a small tolerance space between the outwardly projecting portion 32 and the top wall 18. As discussed above, the lid braces 39 can also be positioned to support and strengthen the depending wall 38 on both sides of the gap 40 as shown in FIG. 5. In another form, one or more braces can be provided on the inner depending wall 36, such as spaced along the sides and front of the inner depending wall 36. So configured, the cover 24 and the top wall 18 secure together while still including strengthening structure.

Figure 3:
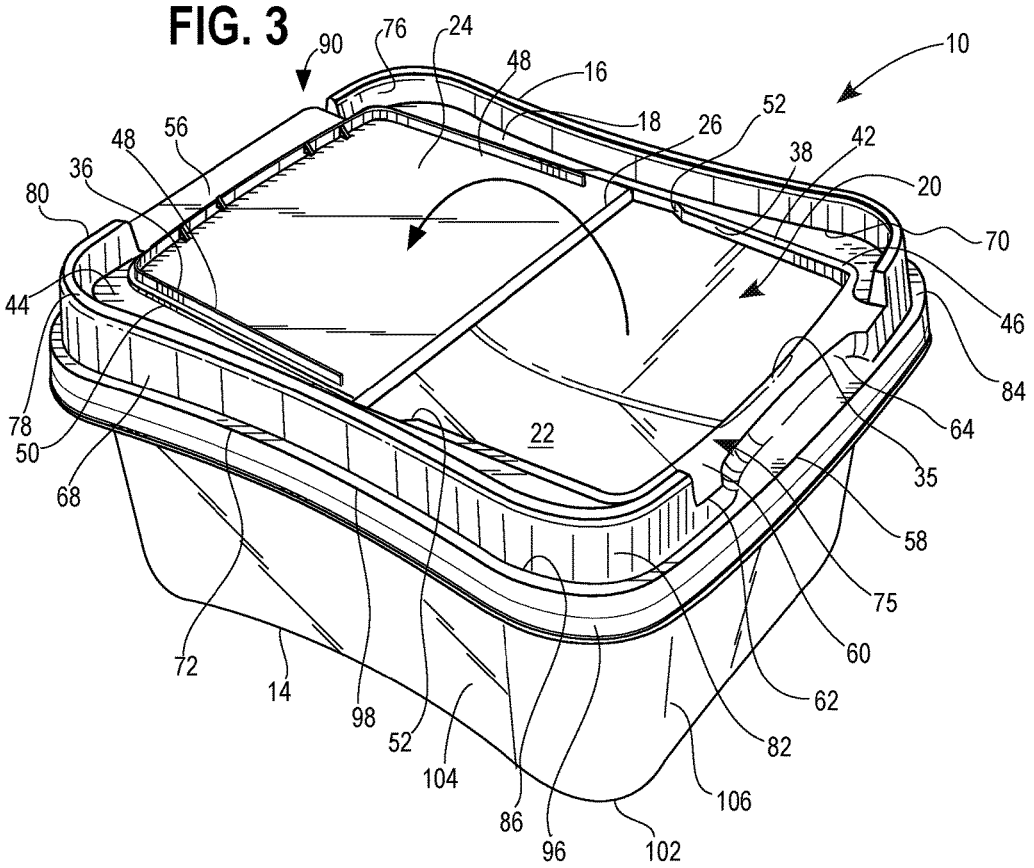
FIG. 3 is a perspective view of the package of FIG. 1 showing the cover pivoted to an open position with a tab thereof captured within a depression in the lid.
Figure 4:
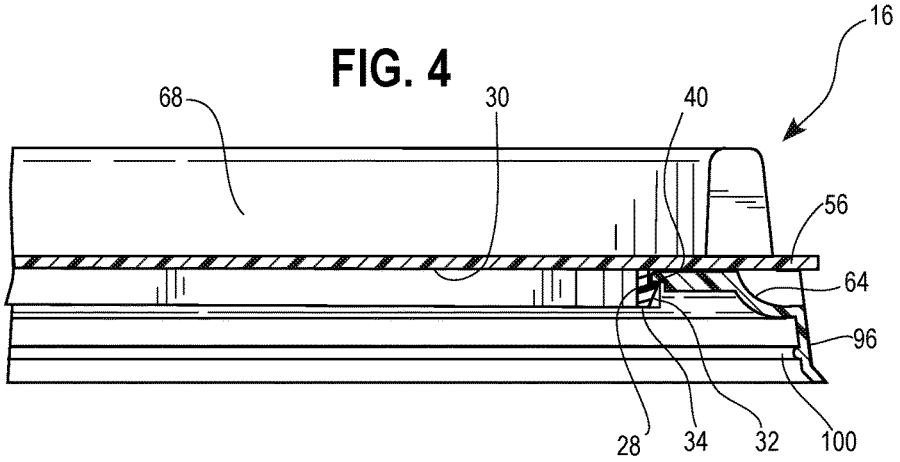
FIG. 4 is a cross-section view of the lid of FIG. 1 taken along the line 4-4 showing the cover secured in the closed position.

The top wall 18 may further include a recessed lip 42 as illustrated in FIGS. 2 and 3. The recessed lip 42 is spaced from a top surface 44 of the top wall 18, such as generally the depth of the cover 24 so that the cover 24 can lie flat in the closed configuration with respect to the top wall 18. The lip 42 includes an upward facing surface 46 that abuts and supports edge portions 48 of the cover 24 in the closed configuration. So configured, in this form, the inner depending wall 36 is spaced from peripheral edges 50 of the cover 24 such as a width equal to or greater than a width of the recessed lip 42. In the illustrated form, the lip 42 extends around a majority of the edges 50 of the cover 24 other than the hinge 26.

As shown in FIGS. 2, 3, and 5, the lip 42 is spaced from the hinge 26 and the bottom of the cover 24. The lip 42 also includes an inwardly angled transition surface 52 positioned adjacent the hinge 26. Being spaced from the hinge 26 and including the transition surface 52 advantageously allows the inner depending wall 36 of the cover 24 to seamlessly enter the opening 20. As shown in FIG. 5, a leading edge 54 of the inner depending wall 36 is positioned between the hinge 26 and the transition surface 52. Without spacing and/or the transition surface 52, the leading edge 54 of the inner depending wall 36 could impact the top surface 44 of the lip 42 and be forced outward which would prevent the cover 24 from closing correctly and/or damage the inner depending wall 36 or the lip 42.

As shown in the figures, the cover 24 may further include a gripping portion or tab 56. In the illustrated form, the cover 24 has a generally trapezoidal or rectangular shape. In this form, the tab 56 is positioned on an edge of the cover 24 opposite the hinge 26. It will be understood, however, that the tab 56 could also be positioned on side edges of the cover 24 or the cover could take alternative shapes, such as triangular, rounded, or the like, and as such, the tab 56 would be positioned available edges of such suitable shapes. The tab 56 is configured to provide a consumer with a convenient area to grip the cover 24 to pivot it about the hinge 26 and expose the opening 20.

As illustrated in FIGS. 2 and 3, the recessed lip 42 can extend to a forward edge 58 of the lid 16 to form a tab recess 60. The tab recess 60 is preferably recessed with respect to the top surface 44 of the top wall 18 equal to or greater than a depth of the tab 56. This advantageously allows the cover 24 to lie flat with respect to the top surface 44 of the top wall 18 when in the closed configuration. The tab 56 preferably extends through the tab recess 60 and past an outer edge 62 thereof to provide a consumer with an easier gripping surface. In another form, the tab recess 60 includes a further recessed indentation 64 that allows additional access to a bottom surface of the tab 56.

Turning now to additional features of the lid 16 as shown in FIGS. 1-5, an upstanding wall 68 extends partially around a peripheral edge 70 of the top wall 18. The wall 68 strengthens the lid 16 against twisting and/or bending undesirably, as well as providing secure stacking for a second package 10 placed on top of the first package 10. In the illustrated form, the upstanding wall 68 extends the entire length of both side edges 72 of the lid 16 and extends at least partially along end edges 74 of the lid 16. The wall 68 includes a gap 75 adjacent the forward edge 58 of the lid 16 through which the tab recess 60 and the tab 56 of the cover 24 extend. The gap 75 also provides a smaller width that provides better control for dispensing the food product 12 therethrough. The wall 68 includes an interior wall surface 76 that extends upwardly from the top wall 18 at a slight angle to an upwardly facing rim 78. The wall 68 then extends downwardly and slightly outwardly from an outer edge 80 of the rim 78 to form an exterior wall surface 82. The wall 68 can further include one or more support braces 83 that span between the interior and exterior wall surfaces 76, 82, which provide greater structural support to the wall 68 to resist twisting and/or bending.

A shoulder 84 extends generally outwardly from a bottom edge 86 of the exterior wall surface 82. The shoulder 84 is configured to rest on a rim of the container 14. Preferably, the exterior wall surface 82 has a greater height than the interior wall surface 76 so that the bottom edge 86 of the exterior wall surface 82 is lower than the top wall 18, so that the opening 20 is spaced from the rim of the container 14. This advantageously provides additional height to the lid 16 allowing structure below the top wall 18, such as the recessed lip 42 with the tab recess 60 having the indentation 64, as well as the inner and outer depending walls 36, 38 to strengthen the cover 24 and the top wall 18.

The upstanding wall 68 can further be utilized to secure the cover 24 in the open configuration. The wall 68 includes a tab retaining gap or recess 90 that receives the tab 56 therein in the open configuration. In the illustrated form, the tab 56 projects forwardly of the cover 24 and accordingly, the gap 90 is provided in a rear edge portion 92 of the lid 16. It will be understood, however, that if the tab was positioned on other sides of the cover, or the cover had a different shape and/or size, as discussed above, the tab retaining gap could be positioned to receive the tab accordingly. The tab retaining gap 90 can have a depth so as to align with the top wall 18 or alternatively can be slightly raised with respect to the top wall 18 as illustrated. By one approach, sidewalls 94 of the tab retaining gap 90 taper inwardly so that the gap 90 has a width adjacent the top wall 18 that is equal to or larger than a width of the tab 56 and a top width that is smaller than the width of the tab 56. So configured, the tab 56 can be manipulated or forced into the gap 90 and the smaller top width of the gap 90 captures the tab 56 within the gap 90. Then when reclose is desired, a user can pull the tab past the small width of the gap 90 to pivot the cover 24 to the closed configuration. Preferably, the tab 56 is sufficiently resilient to withstand the slight deformation needed to pass through the smaller width of the gap 90 to at least partially return to its original configuration. By another approach, the sidewalls 94 of the gap 90 are generally vertical, but the width of the gap 90 is slightly smaller than the width of the tab 56. So configured, the tab 56 can be forced into the gap 90 and the smaller width of the gap 90 slightly deforms the tab 56 to frictionally hold the cover 24 in the open configuration. Then when reclose is desired, a user can force the tab 56 out of the gap 90 and preferably, the tab 56 is sufficiently resilient to at least partially return to its original width.

As discussed above, the lid 16 is configured to attach to a container, such as shown in FIGS. 1-3. To achieve this, by one approach, the lid 16 includes a flange 96 that depends downwardly from an outer edge 98 of the shoulder 84. Preferably, the shoulder 84 rests on a rim of the container 14 so that its outer edge 98 aligns with an outer edge of the rim of the container 14. The flange 96 then abuts a side of the container rim as it extends downwardly. A lip or protrusion 100 projects inwardly from the flange 96 and is configured to project below the container rim when the lid 16 is secured to the container 14. The lip 100 is configured to abut the rim of the container as the lid 16 translates upward to resist removal.

By one approach, the lid 16 is formed with an injection molding process. In a typical injection molding process, lid material is heated, mixed, and forced into a mold cavity. The material cools and hardens to form the final product. The mold is then separated and the lid is removed. In an exemplary molding process, the mold cavity shapes the lid 16 in a single piece. To create a unitary lid with a pivotable cover using an injection molding process, the mold cavity is designed to position the cover in an open configuration, such as generally perpendicular with the top wall 18. So configured, the lid material is injected into the mold and the cover is formed pivotably attached to the top wall 18 by a living hinge and the cover 24 and opening 20 are formed separately. Additionally, as shown, the cover 24 has a trapezoidal shape where the sides taper inwardly as they extend away from the top wall 18. This shape allows the cover 24 to be more easily removed from the mold after the lid 16 is formed.

As described herein, the lid 16 can be configured to attach to any suitable container shape and size. In the illustrated form, however, the container 14 includes a generally rectangular base 102 with upwardly extending sidewalls 104 and end walls 106. The sidewalls 104 and end walls 106 extend to an upwardly facing rim. The rim extends outwardly from the container walls and includes a downwardly depending flange. Such a container can advantageously be formed using a similar injecting molding process, as described above. The container can further have labeling or etching applied to it. Advantageously, injection molding can utilize an in-mold labeling technique to apply labeling to the container 14 and lid 16 during formation thereof. Additionally, the container 14 and/or the lid 16 can include etching on surfaces thereof including decorative graphics, alphanumeric content, or the like.

In the illustrated form, the sidewalls of the container 14 and lid 16 are waisted with inwardly curved walls. This configuration provides a consumer with a container and lid having an enhanced gripping surface or shape. The consumer opens the lid 16 to expose the opening 20, grips the inwardly curved sidewalls 104 of the container 14, and dispenses the food product 12, such as by shaking the container or utilizing a utensil to access the food product 12 in the container 14.

In one example food packaging process, the lid 16 and container 14 are formed, such as utilizing injection molding as described above. If desired, in-molding labeling and/or etching can be utilized to apply packaging details/decorations. So formed, the container is filled with a food product and sealed using a suitable packaging film. This process can further include an atmosphere altering step if desired/required for the chosen food product. The lid 16 is attached to the container 14 over the packaging film. An additional overwrap or other material can be applied over the coupled container and lid to hold them together during storage, shipping, and display, if desired. Once purchased, a consumer removes the lid, removes the packaging film to open the container, and reapplies the lid. The consumer can then sequentially remove the food product through the opening 20 in the lid 16 and reclose the lid 16 using the cover 24.

In one example, the lid 16 is generally rectangular with a maximum length of about 4.65 inches, a maximum width of about 3.9 inches, and a depth of about 0.6 inches. The cover includes inwardly curved sidewalls with a radius of about 4.6 inches and a minimum width of about 3.7 inches. The hinge and bottom of the cover are about 2.8 inches, the sides of the cover are about 1.9 inches, and the top of the cover is about 2.6 inches. The tab of the cover is about 1.9 inches long and 0.3125 inches wide. The opening generally mirrors the dimensions of the cover except for the recessed lip having a width of about 0.0625 inches. The opening is spaced from the forward edge of the lid such that there is about 0.25 inches of impediment in the food product dispensing path. The top wall 18 is generally rectangular with a length of about 4 inches and a width of about 3.25 inches. The top wall 18 includes concave sidewalls with a minimum width of about 3 inches. Therefore, the opening is about 30 percent to about 60 percent of the top wall, and preferably more than 40 percent. The upstanding wall includes an interior surface of about 0.25 inches, a top surface of about 0.1 inches, and an exterior wall of about 0.375 inches. The container is about 2.1 inches deep, and includes a maximum width of about 3.75 inches, a minimum width of about 3.5 inches, and a length of about 4.6 inches. The container includes a draft angle of slightly less than about 90 degrees. The bottom corners of the container are rounded with a dimension of about 0.3 inches. The container is sized to hold about 6 oz. of food product with an overflow capacity of about 400 mL, which can include various cheese products, including crumbles, chunk, shreds, shaves, grated, and powdered, to name a few, as well as other shakable food products.

The drawings and the foregoing descriptions are not intended to represent the only forms of the container and methods in regards to the details of construction. Changes in form and in proportion of parts, as well as the substitution of equivalents, are contemplated as circumstances may suggest or render expedient.

The invention claimed is:

1. A method of opening a package for a foodstuff having a lid secured to a container, the method comprising:

gripping a tab of a cover attached to a top wall of the lid by a hinge;

disengaging a portion of the cover from the top wall, the disengaging the portion of the cover from the top wall comprising disengaging an upwardly facing surface of a protuberance depending downwardly and projecting outwardly from the cover from a bottom surface of the top wall;

pivoting the cover about the hinge from a closed position toward an open position to expose an opening in the top wall and provide access to an interior of the container therethrough; and securing the cover in the open position by capturing the tab within a notch in a periphery of the lid.

2. The method of claim 1, further comprising:

freeing the tab from the notch in the periphery of the lid;

pivoting the cover about the hinge to the closed position to cover the opening; and engaging the portion of the cover with the top wall to hold the cover in the closed position.

3. The method of claim 1, wherein a bottom surface of the top wall comprises a strengthening rib extending downwardly therefrom, the strengthening rib being disposed between the opening in the top wall and the outer edge portion of the top wall, the strengthening rib being adjacent to the protuberance when the cover is in the closed position.

4. The method of claim 2, wherein the cover comprises:
an inner depending wall extending downwardly from at least portions of a periphery region of the cover; and
an outer depending wall extending downwardly from at least portions of a periphery of the opening of the top wall bottom surface, wherein the inner depending wall and the outer depending wall extend downwardly adjacent to one another when the cover is in the closed position.

5. The method of claim 4, wherein the cover comprises a protuberance extending outwardly from a portion of the inner depending wall, the outer depending wall including a gap extending entirely therethrough in a directly generally parallel with the top wall, the protuberance being received through the gap when the cover is in the closed position.

6. The method of claim 4, wherein a bottom surface of the top wall is planar around the opening of the top wall, and wherein the providing of the outer depending wall further comprises disposing the top wall such that the outer depending wall extends downwardly from the planar bottom surface of the top wall.

7. The method of claim 1, wherein the lid comprises an upstanding wall extending around portions of a peripheral edge of the top wall, the tab being captured within a gap in the upstanding wall to hold the cover in the open position.

8. The method of claim 7, wherein the lid comprises a shoulder positioned outwardly of the top wall and the upstanding wall, the shoulder being disposed on a rim of the container.

9. A method of opening a package for a foodstuff having a lid secured to a container, the method comprising:
gripping a tab of a cover attached to a top wall of the lid by a hinge;
disengaging a portion of the cover from the top wall;
pivoting the cover about the hinge from a closed position toward an open position to expose an opening in the top wall and provide access to an interior of the container therethrough; and
securing the cover in the open position by capturing the tab within a notch in a periphery of the lid;
wherein the top wall comprises a recessed lip extending inwardly adjacent the opening, the recessed lip including an upward facing surface configured to support edge portions of the cover when the cover is in the closed position, and wherein a depth of the recessed lip is substantially equal to or less than a depth of edge portions of the cover.

* * * * *